United States Patent [19]

Riggs

[11] 4,307,593

[45] Dec. 29, 1981

[54] APPARATUS FOR FORMING COLLARS AROUND OPENINGS IN TUBES OR PLATES

[75] Inventor: William H. Riggs, Saline, Mich.

[73] Assignee: T/Drill, Inc., Ann Arbor, Mich.

[21] Appl. No.: 132,379

[22] Filed: Mar. 21, 1980

[51] Int. Cl.[3] ..... B21B 3/06

[52] U.S. Cl. ..... 72/125; 72/325

[58] Field of Search ..... 29/157 T; 72/112, 117, 72/120, 125, 325

[56] References Cited

U.S. PATENT DOCUMENTS

| | | | |
|---|---|---|---|
| 3,592,038 | 7/1971 | Larikka | 72/325 |
| 3,817,071 | 6/1974 | Chalvignac | 72/120 |
| 3,844,149 | 10/1974 | Hansen | 72/325 |

*Primary Examiner*—James G. Smith

*Attorney, Agent, or Firm*—Olsen and Stephenson

[57] ABSTRACT

Collar forming apparatus for forming an upstanding flange around an existing hole in a tube or plate comprising a pair of forming members mounted on and movable axially and radially with respect to the forming head between retracted positions and extending collar forming positions displaced axially and radially away from the retracted positions wherein at least portions of the forming members underlie the edge of the wall surrounding the opening. The forming members are moved to their collar forming positions by a wedge member that is movable axially with respect to the forming head to a predetermined axial position. Abutment means in the form of cooperating surface portions on the wedge member and the formation means acts between the wedge member and the formation means to impart radial and axial forces on the formation means when the wedge member is moved to its predetermined axial position to move the forming members to their collar forming positions. Means is provided for maintaining the wedge member in its predetermined axial position to provide axial and radial support for the forming members as the material is worked in forming a collar.

12 Claims, 6 Drawing Figures

42
46
54
68
70
66
62
106
5
93
92
95
94
98
44
112
12
16
96'
72
80
100
104
96

APPARATUS FOR FORMING COLLARS AROUND OPENINGS IN TUBES OR PLATES

BACKGROUND OF THE INVENTION

The present invention relates to a collar forming apparatus for forming a collar or neck around an opening in a tube or a plate. Collar forming apparatus of this type is operable to work the metal surrounding an opening in the wall of a tube or a plate to flare the edge of the metal surrounding the opening outwardly and increase the size of the opening until an outwardly projecting collar or neck is formed around the enlarged opening. The collar forms a support to which a branch tube is affixed.

A composite hole forming and collar forming apparatus is described in U.S. Pat. No. 3,592,038 issued on July 13, 1971. The drilling and collar forming device disclosed in this patent employs at least two flange forming tools mounted on a drill and movable from retracted positions into extended positions displaced from the lateral surface of the drill wherein the end portions of the flange forming tools underlie the edge of the wall of the tube surrounding the opening. The forming tools then are rotated as the device is withdrawn from the hole to work the metal surrounding the opening to form an upstanding flange around the opening. A branch pipe then can be secured to the collar to be in communication with the main pipe. Forming an integral collar around an opening in the wall of the tube is advantageous because it eliminates the costly and difficult procedure of attaching T-fittings to the main tube. In addition, the structural integrity of the connection is ensured because the collar is an integral extension of the main tube.

Although the drilling and collar forming apparatus disclosed in U.S. Pat. No. 3,592,038 performs remarkably well, there are some limitations which are eliminated by the present invention. Because the flange forming tools are arranged in the drill disclosed in U.S. Pat. No. 3,592, 038 in a criss-cross manner, there are limits on the sizes of the openings around which a collar can be formed. Additionally, the forming tools disclosed in this patent have a cylindrical configuration and thus are not suitable for forming collars in tubes having a wide variety of wall thicknesses and varying material compositions. Finally, the drilling and collar forming apparatus disclosed in this patent is not capable of accepting flange forming tools of different sizes.

It is the general object of this invention, therefore, to provide a collar forming apparatus which is readily adapted to form collars around openings in tubes or plates having a variety of wall thicknesses and material compositions.

It is another object of the present invention to provide a collar forming apparatus having an improved mode of extending and retracting flange forming members.

It is another object of the present invention to provide a collar forming apparatus having flange forming members of improved design.

SUMMARY OF THE INVENTION

The collar forming apparatus of the present invention consists of a collar head to which a pair of flange forming members are affixed. The collaring head is secured to the spindle of a drive unit which is movable reciprocally along an axis to move the collaring head and flange forming members into an opening formed in a tube and to withdraw them in the process of forming a collar or neck around the opening in the tube. The flange forming tools are slidably mounted on inclined mounting members secured to the collaring head. The mounting members are arranged on the collaring head such that the flange forming members are movable axially and radially with respect to the collaring head between retracted positions and extended collar forming positions displaced axially and radially outwardly from their retracted positions.

The collar forming apparatus further includes a wedge member movable reciprocally along the axis of the collaring head and operable to cause the flange forming members to be moved to their collar forming positions. Abutment means acts between the wedge member and the flange forming members to impart axial and radial forces on the flange forming members when it is moved to a predetermined axial position to move the flange forming members to their extended collar forming positions. Means is provided to maintain the wedge member in its predetermined axial position to provide axial and radial support for the flange forming members as the metal is being worked to form the collar around the opening in the tube.

The flange forming members are easily removed from the collaring head and replaced by other formation members to meet changing hole sizes, wall thicknesses and material compositions. Each of the flange forming members has a working surface, a portion of which is curved in planes extending substantially perpendicular to the longitudinal axis of the formation member and a portion of which is curved both in planes extending substantially perpendicular to the longitudinal axis and to planes extending substantially parallel to the longitudinal axis to form a rounded nose portion. Opposite side wall portions extend substantially perpendicular with the working surface and parallel with the axis of the formation member to provide a compact flange forming member. Since the working surface of the flange forming member has a large radius so that it is slightly curved, it is particularly advantageous in forming collars around openings having a large diameter. Also, the flange forming members are effective in forming flanges in tubes having a variety of material compositions and wall thicknesses.

Further objects, features and advantages of the present invention will become apparent from a consideration of the following description when taken in connection with the appended claims and the accompanying drawing in which:

Figure 1:
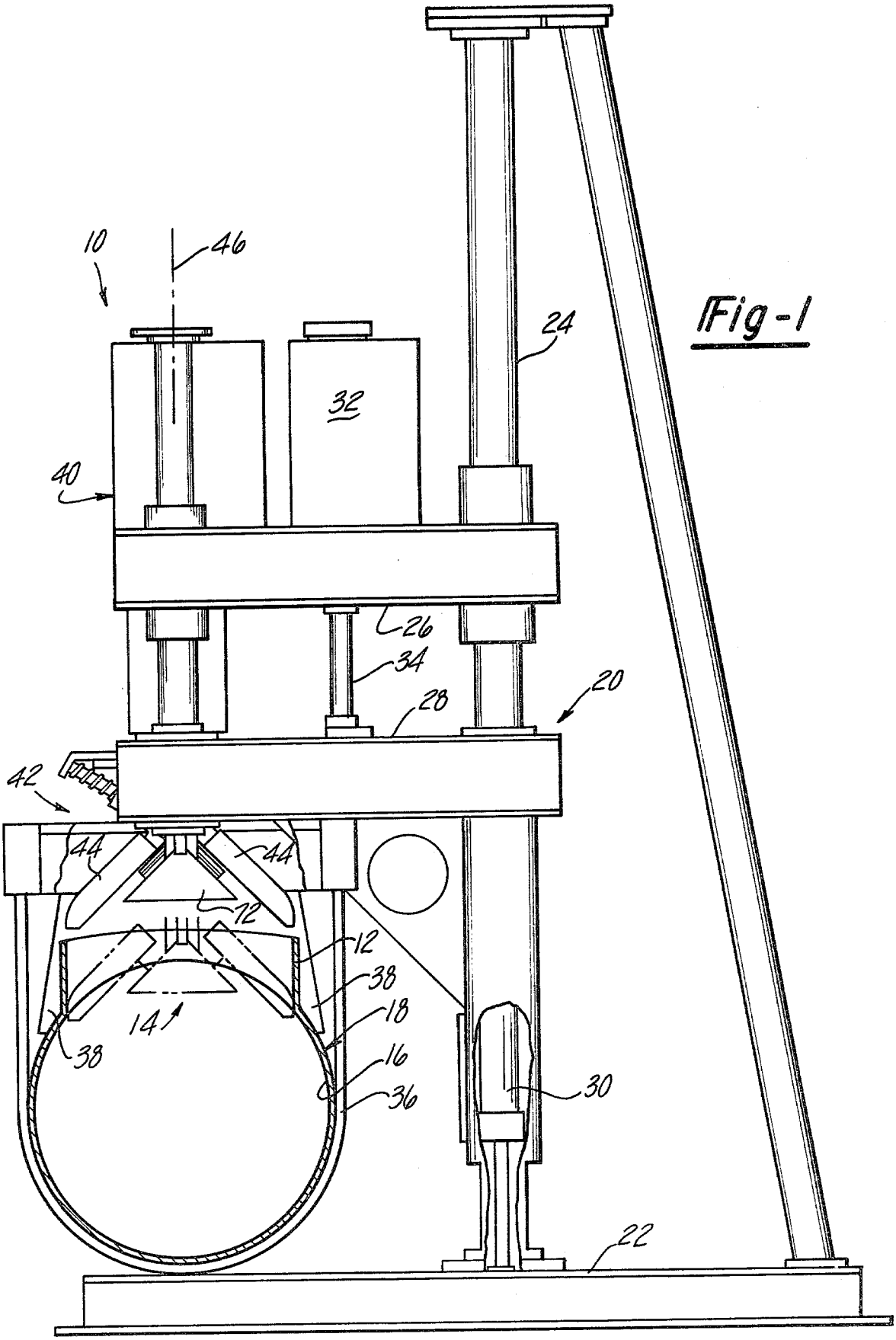
FIG. 1 is a side elevational view of the collar forming apparatus of the present invention on which a tubular member, shown in section, is secured and which shows a pair of flange forming members in their extended collar forming positions at locations at the beginning of the collar forming procedure (broken lines) and after the collar forming procedure.

Referring to the drawing, the collar forming apparatus of the present invention, indicated generally at 10, is shown in FIG. 1 in a position immediately subsequent to the forming of a collar or neck 12 around an opening 14 in the wall 16 of a tube 18. The collar forming apparatus 10 includes a frame 20 having a base 22 on which upright support columns 24 (one shown) are secured. A pair of vertically spaced apart tables 26 and 28 are slidably mounted on the support columns 24 for movement relative to the base 22 and for movement relative to each other. A hydraulic cylinder 30 is interposed between the base 22 and the lower table 28 and is operable to raise and lower the table 28. A hydraulic cylinder 32 having a rod 34 connects the upper table 26 with the lower table 28 in an adjusted fixed position so that operation of the hydraulic cylinder 30 causes simultaneous movement of the tables 26 and 28 and operation of the cylinder 32 causes relative vertical movement between the upper table 26 and the lower table 28.

Tube clamping apparatus in the form of a flexible member 36 is secured to the underside of the lower table 28 and wraps around the tube 18 holding it firmly against support feet 38 secured to the underside of the table 28. The vertical adjustable movement of the table 28 allows the collar forming apparatus 10 to accommodate tubes having a variety of diameters.

The upper table 26 carries a drive unit 40 which extends through the lower table 28 for vertical movement relative thereto and to which is secured a collaring head 42. Collar or flange forming members 44 which form formation means are mounted on the collaring head 42 and are operable to engage the metal surrounding the opening 14. When rotated by the drive unit 40 about an upright axis 46 of the collaring head 42 while being withdrawn from the hole 14 in an axial path the formation members 44 work the metal to form the collar 12. The reciprocal movement of the collaring head 42 along the axis 46 is achieved by operation of the cylinder 32 which causes the upper table 26 to move up and down relative to the table 28 so as to coincidentially move the collaring head 42 and the formation members 44 up and down.

Figure 2:
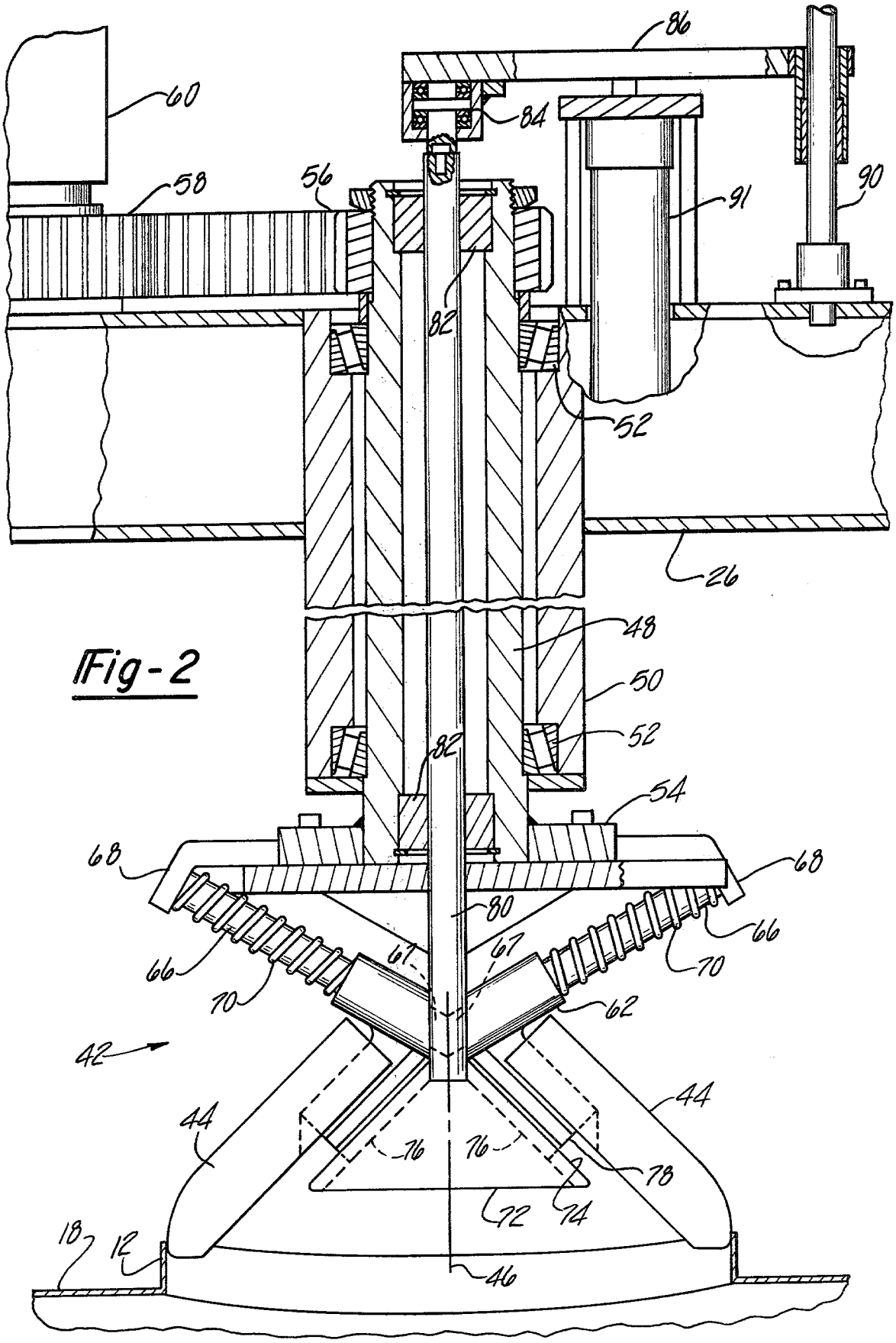
FIG. 2 is an elevational view of a portion of the collar forming apparatus with portions shown in section and with the lower table not shown for the purpose of clarity.

As seen in FIG. 2, the drive unit 40 consists of a quill 48 rotatably mounted in a housing 50 by upper and lower taper rolling bearings 52. The housing 50 is mounted on the upper table 26 so that the collaring head 42 moves coincidentally with the upper table 26. The lower end of the quill 48 carries a spindle 54 to which the collaring head 42 is attached. A gear 56 is attached to the upper end of the quill 48 and meshes with a drive gear 58 that is driven by a motor 60. Operation of the motor 60 causes the quill 48 to rotate about the axis 46 thereby causing the formation members 44 to likewise rotate.

Figures 3, 4, 5:
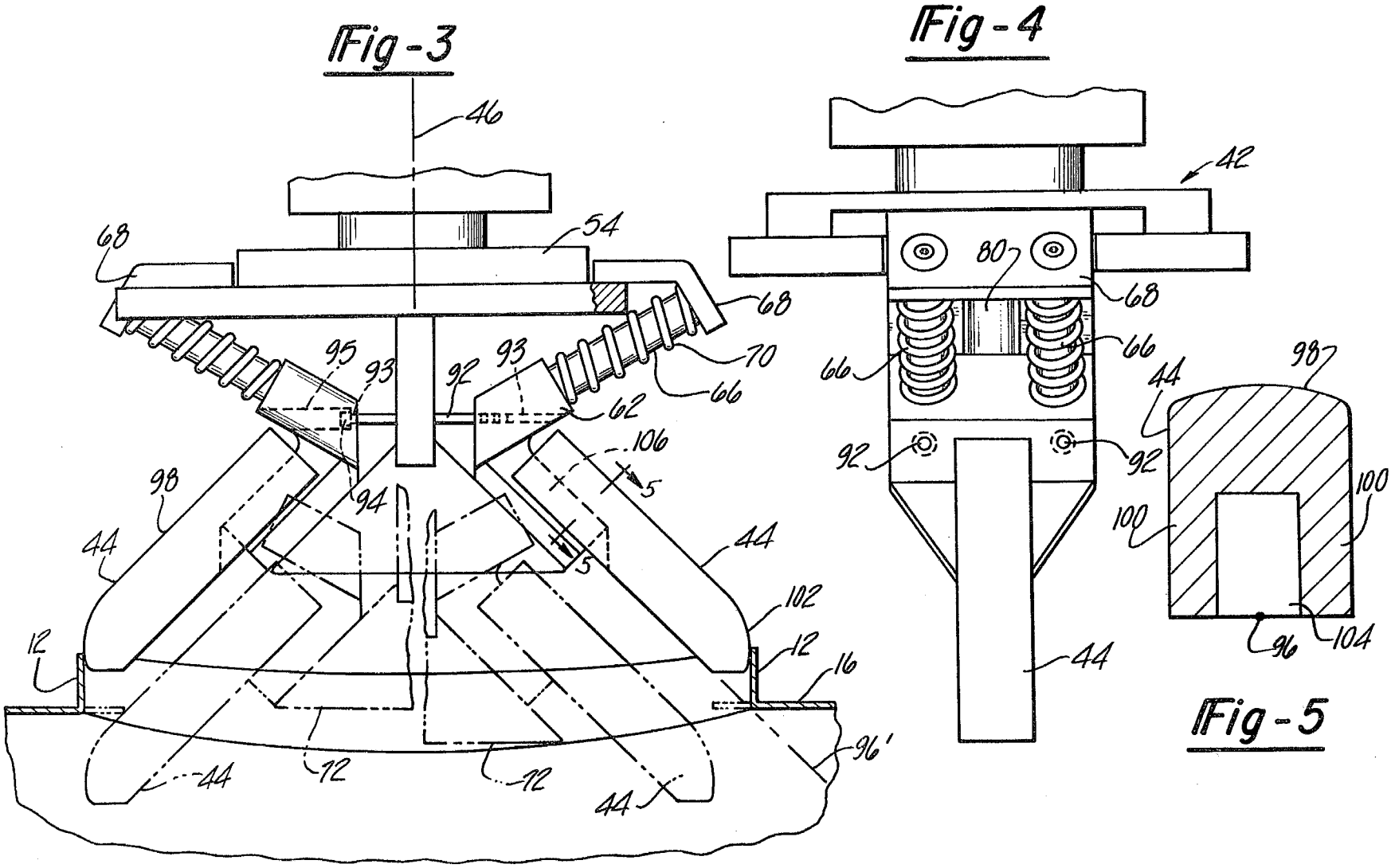
FIG. 3 is a fragmentary elevational view of the collaring forming apparatus of the present invention showing in broken lines the retracted and extended collar forming positions of the flange forming members and showing in unbroken lines the flange forming members in their extended collar forming positions withdrawn from the tube.
FIG. 4 is a side elevational view of the collaring head shown in FIG. 3.
FIG. 5 is a sectional view of a flange forming member taken substantially from line 5—5 in FIG. 3.

The collaring head 42 carries the symetrically arranged flange forming members 44 and there is provision for mounting the members 44 onto the collaring head 42. As shown in FIGS. 2–4, each flange forming member 44 is removably secured to a support member 62 having a pair of hollow sleeve portions 64 that receive parallel cylindrical mounting rods 66. The mounting rods 66 are inclined upwardly away from the axis 46 and each is attached at its upper end to an arm 68 on the collaring head 42. The mounting rods 66 are symmetrically arranged so that their lower ends 67 abut one another (FIG. 2) to form a V-shape configuration which provides a solid support for the support members 62 and the collar forming members 44.

The support members 62 and the attached collar forming members 44 are slidably movable on the mounting rods 66 between retracted positions shown in FIG. 2 and extended collar forming positions displaced axially above and radially outwardly from their retracted positions as shown in FIG. 3. Spring members 70 are carried by the mounting rods 66 and are interposed between the support members 62 and the arms 68 to bias the collar forming members 44 to their retracted positions shown in FIG. 2.

The formation members 44 are displaced to their extended collar forming positions by a wedge member 72 that is movable reciprocally along the axis 46. The wedge member 72 has surfaces 74 inclined with respect to the axis 46. Grooves 76 are formed in the surfaces 74 of the wedge member 72 and receive rib portions 78 on the support members 62. The grooves 76 and the rib portions 78 have cooperating flat surface portions that are inclined with respect to the axis 46 at substantially the same angle. Movement upwardly of the wedge member 72 causes the cooperating surface portions on the ribs 78 and the grooves 76 to impart axially upward and radially outward forces on the support members 62 to move the collar forming members 44 to their collar forming positions.

The wedge member 72 is attached to a draw bar 80 which extends through the quill 48 and is supported therein for vertical movement by the bushings 82 disposed in the quill 48 at its upper and lower ends. The upper end of the draw bar 80 is attached by a thrust bearing assembly 84 to an actuating rod 86 having attached at its opposite end a sleeve 88 that receives a guide column 90 secured to the upper table 26. A hydraulic cylinder 91 that is mounted on the upper table 26 is connected to the actuator rod 86 and when operated serves to raise and lower the draw bar 80 and wedge 72 along the axis 46 with the guide column 90 insuring the vertical movement of the draw bar 80. The hydraulic cylinder 91 also serves to maintain the wedge member 72 in a predetermined axial position in which the forming members 44 are held in their collar forming positions to provide both axial and radial support for the members 44 when the collar forming step is being carried out. When the quill 48 is rotated, the draw bar 80 and the wedge member 72 are also rotated by virtue of the engagement of the wedge 72 with the support member 62. Rotation of the draw bar 80 is enabled by virtue of the thrust bearing assembly 84 so that no rotative forces are transmitted to the actuator member 86.

As shown in FIGS. 3 and 4, adjustment pins 92 are employed to define the extended collar forming positions of the formation members 44. Aligned openings 93 which extend perpendicular to the axis 46 are formed in the support members 62. As seen in FIG. 3, the opening 93 in the right hand support member 62 is threaded and the opening 93 in the left hand support member 62 is in communication with an enlarged opening or passageway 95. Each pin 92 is extended through the openings 95 and 93 in the left hand support member 62 and is threadably fitted in the opening 93 in the right hand support member 62. Each pin has a head 94 which has a size that enables it to move through the passage 95 but that prevents it from passing through the opening 93. As shown in FIG. 3, the head 94 abuts the left support member 62 to define the extended collar forming positions of the formation members 44 and thereby prevent further outward movement of the formation members 44. The pins 92 can be rotated to vary the collar forming positions of the formation members 44. During the collar forming step, the wedge 72 is forced upwardly with its upward movement limited by the pins 92 and provides radial and axial support for the formation members 44 to hold them in their collar forming positions as the metal surrounding the opening 14 is being worked to form the collar 12. After the collar forming step has been completed, the wedge 72 is lowered allowing the springs 70 to force the support members 62 and the formation members 44 inwardly. The pins 92 thus move relatively outwardly relative to the left hand support member 62 through the openings 93 and 95 since the heads 94 are free to move through the enlarged openings 95.

As shown in FIGS. 3–5, each collar forming member 44 has a longitudinal axis 96 and includes a working surface 98 from which side walls 100 extend transversely. The working surface 98, as seen in FIG. 5, is curved in planes that are substantially perpendicular with respect to the axis 96 and is the surface which engages the metal surrounding the opening 14. The lower end portion 102 of each formation member 44 is curved both in planes that extend substantially perpendicular to the axis 96 and in planes that extend substantially parallel with the axis 96, as seen in FIG. 3, so that the end portion 102 forms a rounded nose portion. A longitudinal groove 104 is formed in each formation 44 and receives a rectangular mounting portion 106 on the support member 62 and is secured thereto in a suitable manner. Accordingly, a variety of sizes and shapes of the formation members 44 can be interchangeably mounted on the support members 62 to fit the hole size, the wall thickness, and the composition of the tube 18. As shown in FIG. 3, the mounting portions 106 on the support members 62 are inclined with respect to the axis 46 at an angle that corresponds with the angle of inclination of the surfaces 74 on the wedge 72.

Figure 6:
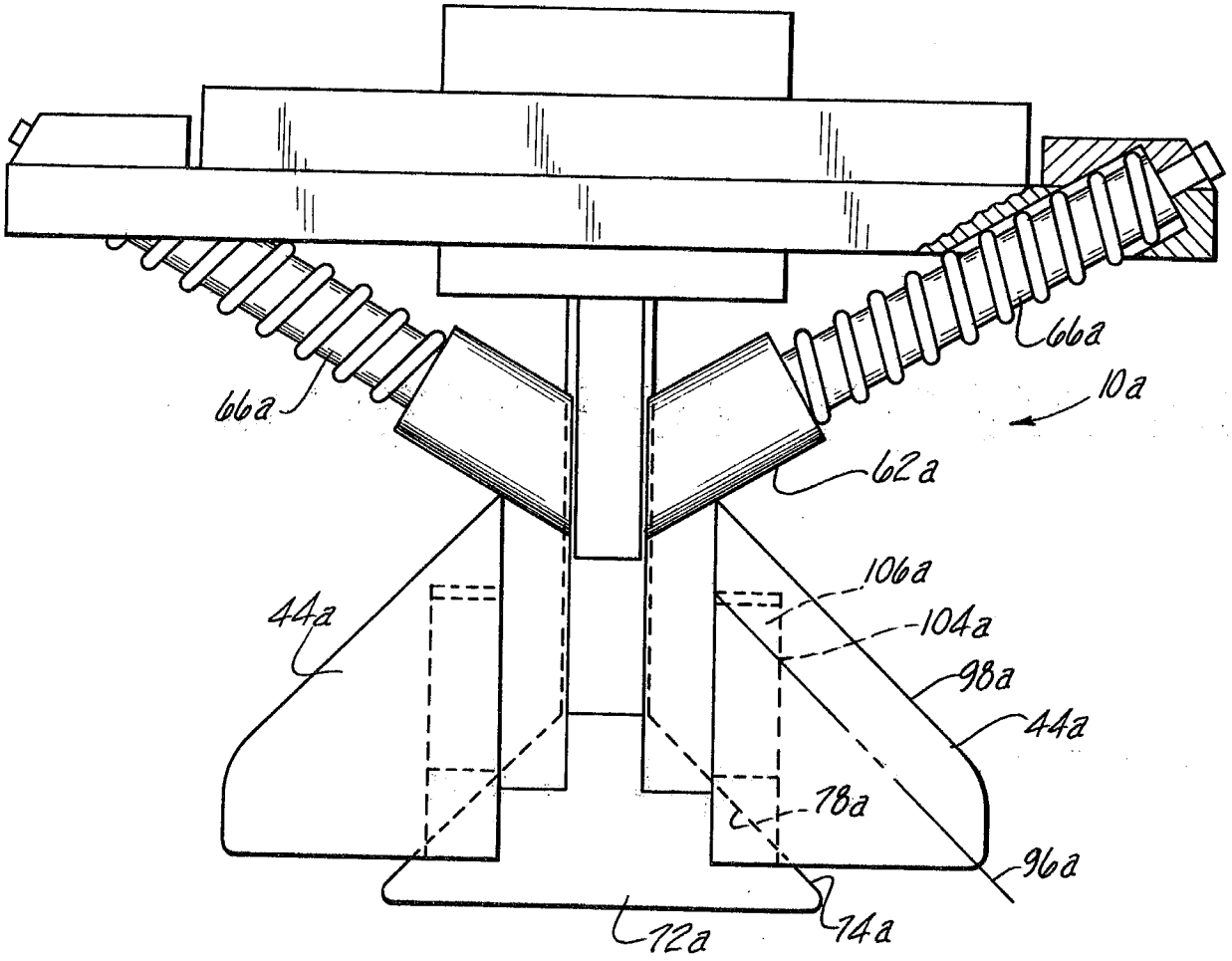
FIG. 6 is an elevational view of a modified embodiment of the collar forming apparatus of the present invention.

A modified form of the collar forming apparatus 10 is illustrated at **10*a* in FIG. 6. The construction of the collar forming apparatus 10*a* is identical with the construction of the collar forming apparatus 10 illustrated in FIGS. 1–5 except for the construction of the support members 62*a* and the collar forming members 44*a*. The collar forming members 44*a* have triangular configuration with a working surface 98*a* that is curved in planes that extend substantially perpendicular to the longitudinal axis 96*a*. Each formation member 44*a* has a rounded lower nose portion 102 that is curved both in planes that extend substantially perpendicular to and substantially parallel to the axis 96*a*. Each support member 62*a* which is slidably mounted on an associated mounting rod 66*a* has an upright mounting portion 106*a* which is received in a groove 104*a* on the formation member 44 to secure the formation member 44*a* on the support member 62*a*. The apparatus 10*a* includes wedge member 72*a* that has inclined surfaces 74*a* which mate with correspondingly inclined surfaces 78*a* on the support members 62*a*. The shape and configuration of the formation members 44*a*** can be modified to be accommodated by a particularly sized opening in a tubular member.

In operation, the tubular member 18 is clamped against the feet 38 by the clamp apparatus 36. The collar forming members 44 are in their retracted positions as shown in broken lines in the right hand side of FIG. 3. In this position, the hydraulic cylinder 92 locates the wedge 72 in its lowered position in cooperation with the springs 70. The hydraulic cylinder 32 is then operated to lower the upper table 26 relative to the table 28 to lower the collaring head 42 to insert the retracted formation members 44 into the opening 14 in the tube 18. Next, the cylinder 91 is actuated to raise the draw bar 48 and the wedge 72 axially to extend the formation members 44 to their extended collar forming positions defined by the adjustment pins 92, as shown in broken lines on the left hand side of FIG. 1 where they underlie the portions of the wall 16 surrounding the opening 14.

The collar 12 then is formed by working the metal surrounding the opening 14. This working of the metal is performed by actuating the motor 60 which rotates the quill 48 about the axis 46 thereby rotating the formation members 44. The cylinder 32 then is actuated to raise the table 26 which withdraws the rotating formation members 44 from the hole 14. During this process, the rotating formation members 44 work the metal surrounding the opening to form the upstanding flange 12 and are held in their collar forming positions by the wedge 72 which is maintained in position by the cylinder 91. As shown in unbroken lines in FIG. 3 and in FIG. 2, the extended formation members are shown in a position where the collar forming procedure is essentially complete. Afterwards, the tube 18 is indexed to another position where another collar can be formed or not another tube is secured to the underside of the table 28 with an opening positioned in alignment with the collar forming head 42.

From the above description, it can be seen that an improved collar forming apparatus 10 is provided which is capable of forming collars in tubes or plates having a variety of wall thicknesses, openings and material compositions. The formation members 44 are readily detached so that other types of formation members can be expeditiously installed in the collar forming apparatus. Employment of the wedge member along with the mounting of the support members 62 enables the collar forming apparatus 10 to be readily adapted to form collars around openings having a wide variety of sizes. Finally, the configuration of the formation members 44 further enhances the versatility and using the collar forming apparatus 10 with openings having a wide variety of sizes.

It is claimed:

1. Apparatus for forming a collar around an opening in a wall comprising a forming head, means for moving said forming head back and forth along an axis, formation means adapted to engage portions of said wall adjacent to said opening to form said collar, means mounting said formation means on said forming head for movement axially and radially with respect to said axis between a retracted position and an extended collar forming position displaced axially and radially outwardly from said retracted position, wedge means movable axially with respect to said forming head and operable when moved to a predetermined axial position to move said formation means to said collar forming position wherein at least portions of said formation means underlie the edge of said wall adjacent said opening, abutment means acting between said wedge means and said formation means to impart axially directed and radially directed forces on said formation means in response to said axial movement of said wedge means to said predetermined axial position to move said formation means to said extended collar forming positions.

2. Collar forming apparatus according to claim 1, wherein said formation means comprises a support member and a formation member secured to said support member.

3. Collar forming apparatus according to claim 2, wherein said mounting means comprises a mounting member extending radially with respect to said axis, said support member being movably mounted on said mounting member for reciprocal movement to carry said formation member between said retracted position and said extended collar forming position.

4. Collar forming apparatus according to claim 1, wherein said abutment means includes coacting surface portions on said wedge means and said formation means, said surface portions on at least one of said wedge means and said formation means being inclined with respect to said axis so that axial movement of said wedge means imparts said axially and radially directed forces on said formation means.

5. Collar forming apparatus according to claim 1 and further including means biasing said formation means radially inwardly toward said retracted positions.

6. Collar forming apparatus according to claim 1 and further including adjustable limit means for restraining further outward radial movement of said formation means from collar forming positions.

7. Collar forming apparatus according to claim 1 and further including means maintaining said wedge means at said predetermined axial position to provide axial and radial support for said formation means.

8. Collar forming apparatus according to claim 3, wherein said mounting member is inclined with respect to said axis.

9. Collar forming apparatus according to claim 1, wherein said formation means includes at least one formation member having a longitudinal axis, a curved working surface and sidewall portions extended transversely from said working surface, said working surface being curved in planes extending substantially perpendicular to said longitudinal axis.

10. Collar forming apparatus according to claim 9, wherein said formation member includes an end portion, and wherein said working surface at said end portion is further curved in planes extending parallel to said longitudinal axis.

11. Collar forming apparatus according to claim 4, wherein said surface portions on said wedge means are inclined a predetermined angle with respect to said axis and wherein said surface portions on said formation means are inclined with respect to said axis at substantially said predetermined angle so that said formation means is moved radially outwardly as said wedge means is moved axially toward said formation means.

12. Apparatus for forming a collar around an opening in a wall comprising a forming head movable reciprocally along an axis, formation means adapted to engage portions of said wall adjacent to said opening to form said collar, means mounting said formation means on said forming head for movement radially of said axis between a retracted position and an extended collar forming position displaced radially from said retracted position, wedge means movable reciprocally along said axis and operable to move said formation means to said collar forming position, abutment means acting between said wedge means and said formation means to impart radially directed forces on said formation means in response to axial movement of said wedge means to a predetermined axial position to move said formation means to said collar forming position, and means maintaining said wedge means in said predetermined axial position as said collar is formed to provide radial support for said formation means.

* * * * *